United States Patent [19]

Seals

[11] Patent Number: 4,960,016

[45] Date of Patent: Oct. 2, 1990

[54] MULTIPURPOSE AUTOMOTIVE TOOL KIT

[76] Inventor: Robert L. Seals, 13524 Autumn La., Chico, Calif. 95926

[21] Appl. No.: 478,451

[22] Filed: Feb. 12, 1990

[51] Int. Cl.[5] ..... B25G 1/00

[52] U.S. Cl. ..... 81/177.4; 81/490; 7/100; 7/138

[58] Field of Search ..... 81/177.4, 437, 490, 81/125.1; 7/100, 138, 165

[56] References Cited

U.S. PATENT DOCUMENTS

| | | | |
|---|---|---|---|
| 752,510 | 2/1904 | Berryman | 81/125.1 |
| 1,416,461 | 5/1922 | Hance | 81/177.4 X |
| 1,558,036 | 10/1925 | Moffitt | 81/437 X |
| 3,370,307 | 2/1968 | Beeks . | |
| 4,122,569 | 10/1978 | Hitchock . | |
| 4,302,990 | 12/1981 | Chrichton et al. | 81/177.4 X |
| 4,399,723 | 8/1983 | Marleau | 81/437 |
| 4,477,936 | 10/1984 | Weston . | |
| 4,699,030 | 10/1987 | Yang . | |
| 4,827,812 | 5/1989 | Markovetz | 81/177.4 X |

*Primary Examiner*—James G. Smith

[57] ABSTRACT

A multipurpose automotive tool kit is provided in a housing which is also a handle. A variety of sockets and other useful tools are stored in the housing and used individually or attached to the housing used as handle. As a handle, the housing acts as both a levering device and as a viable tool having inherent useful sockets immediately available in the surface structure.

5 Claims, 3 Drawing Sheets

MULTIPURPOSE AUTOMOTIVE TOOL KIT

BACKGROUND OF THE INVENTION

1. Field of the Invention

This invention relates to automotive tools and tool kits. The present invention is particularly directed towards a compact hand-held tool which incorporates a variety of exchangeable tool members contained as a kit inside a handle with fittings structured on the handle making the handle itself a useful tool.

2. Description of the Prior Art

Although automotive tools are available abundantly in a variety of combinations and kits, the offered kits and tool combinations are not always suitable for a particular purpose. For example, most tool combinations useful to be carried in the glove compartment of a modern vehicle or in a confined space in the vehicle trunk are provided in a case or as sockets which slide onto a handle. Usually, the handle provides attachment for a single tool at a time and no provision is made for a needed secondary tool being immediately available. Also no combination automotive tools seem to provide a handle in which a variety of sockets can be stored with other useful tools with the handle being both a levering device and having inherent useful sockets immediately available in the handle structure. Typical of single structure multipurpose tools seen in past art patents is shown in Tai-Her Yang, U.S. Pat. No. 4,699,030, on Oct. 13, 1987. He describes spin off wrenches which include allen and socket types attachable to a single handle on a pivotal head.

Another multipurpose tool seen is the "integrated universal tool" of Hitchcock, U.S. Pat No. 4,122,569, issued Oct. 31, 1978. The Hitchcock tool provides everything from a locking knife to a wire crimping tool which are attached pivotal in a keeper ring which slides along the side of the wrench handle.

It would appear the foregoing Hitchcock device was suggested by Beeks, U.S. Pat. No. 3,370,307, issued Feb. 27, 1968. Beeks discloses a crescent wrench in which a flat screwdriver and a Phillips screwdriver slide out the back end of the handle.

Some of the best tool combinations seen are found in bicycle tool offerings. For example, Weston U.S. Pat. No. 4,477,936, dated Oct. 23, 1984, issued describes a multipurpose bicycle tool in the form of a wrench with a variety of other useful bicycle oriented tool attached.

Apparently lacking for automotive use, however, is a versatile multipurpose tool structured common to a single handle with fittings inherent to the handle and the handle serving as a storage case.

SUMMARY OF THE INVENTION

Therefore, to overcome the lack of a multipurpose automotive oriented tool kit contained in a single handle, I have provided such a tool kit in the present invention. In practice, the invention embodies a variety of specific tools and accessories frequently used on automobiles and motorcycles combined in a single handle. The need to store and transport a number of full sized tools within a car, especially a passenger car, where space is limited is therefore eliminated with this one invention. My entire tool kit can be stored in the glove compartment of a car or even in the storage compartment of a motorcycle.

Specifically, the tool kit consists of an elongated open ended tubular handle useful as a tool itself and as housing for attachable tool parts. One end of the handle is ringed by four inherently affixed sockets. The sockets are preferably sized 7/16, ½, 9/16 and ¾ inch. The opposite open end of the handle narrows and forms a fifth socket useful for spark plugs removal. Protruding from the spark plug socket end is the head of a crescent wrench. A short Phillips screwdriver is affixed to the crescent wrench base arranged to position inside the handle housing. The crescent wrench base snaps into a removable socket sized for smaller spark plugs which in turn snaps into a socket useful for larger spark plugs formed into the narrow end of the handle housing. At the opposite end of the handle, a ⅜ inch drive ratchet with quick release for sockets is threadably inserted into the handle housing adjacent the four sockets. The ratchet drive has an elongated shank with the distal end formed into a straight blade or a Phillips screwdriver. Removably housed on the ratchet drive shank are a multiple of variously sizes sockets. Although these sockets may be standard or metric, standard sizes of ½, ⅜, ⅝, 9/16, 11/16, and ¾ inch are the most useful. Slid onto the shank, the sockets are inserted into the handle housing for storage. Metric size sockets could obviously replace the fractional size sockets.

The immediate invention is highly versatile in that the ratchet driver as a socket wrench can be used attached to the handle using the handle as a "cheater" for leverage or the ratchet driver can be used detached with the shank serving as a leverage handle. The crescent wrench is used attached so the housing section of the handle can serve for leverage. When a Phillips screwdriver is needed, the crescent wrench head is unsnapped and pulled from the handle and the Phillips screwdriver can be used with the crescent wrench head for a handle. The shank of the ratchet driver head can be inserted through the smaller of the two inherent sockets of the housing and used as additional leverage when the opposite end of the housing is used for spark plug removal. Where space permits, the inherent sockets of the housing can be used to stabilize the head of a bolt while the ratchet driver with affixed socket is used to tighten or loosen a nut. Even though useful socket sizes have been suggested, it is obvious that other sizes such as metric or combination metric and fractional sockets can be used in conjunction with or in place of the stated sizes.

Therefore, it is a primary object of this invention to provide a multipurpose tool in a single handle having housing in the handle for a variety of useful automotive oriented tools.

Another object of the invention is to provide a multipurpose tool with a handle having inherent sockets around one end which can be used with a ratchet driver head removed from the same housing to stabilize the head of a bolt while the ratchet driver is being used with a socket to tighten or loosen a nut.

A further object of my invention is to provide a multipurpose tool in which a variety of automotive type tools can be retained in a single handle as a tool kit and the entire tool kit can be stored in the glove compartment of a car or even in the storage compartment of a motorcycle.

A still further object of the invention is to provide a single handle useful with a variety of attachable tool which are stored in the handle of the tool with the handle structured for removal and replacement of both large and small spark plugs.

A still further object of my invention is to provide a ratchet driver head and various sized sockets housed removably in a handle in which the ratchet driver head is useful with standard size sockets, metric size sockets, and multiuse sockets.

Many other objects and the advantages of my invention will be understood by reading descriptions of numbered parts in the specification and comparing the described numbered parts with like numbered parts illustrated in the accompanying drawings.

DESCRIPTION OF THE PREFERRED EMBODIMENT

Figure 1:
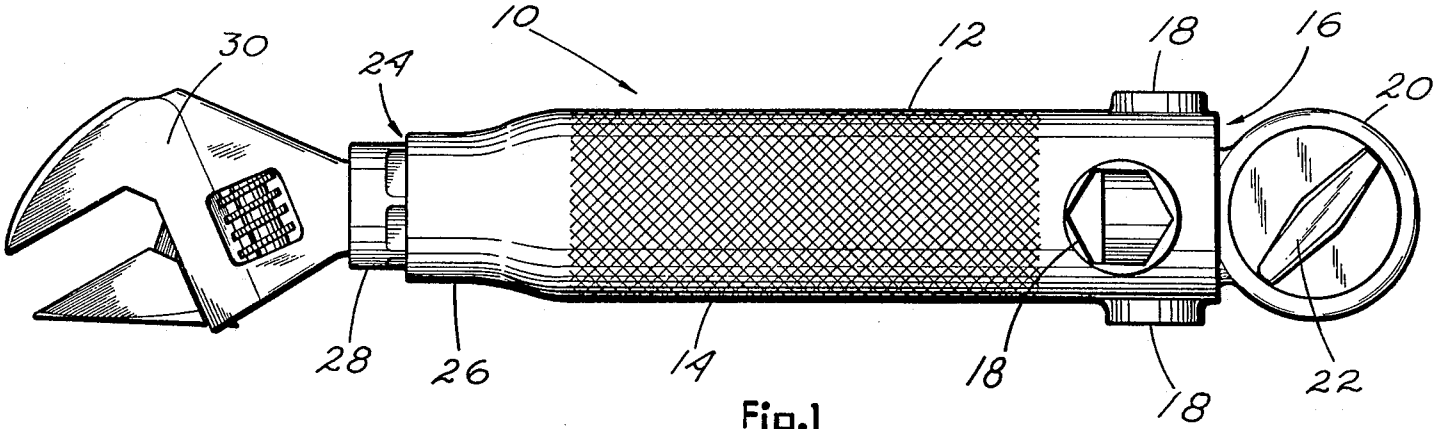
FIG. 1 is an assembled side view of the invention.
Figure 2:
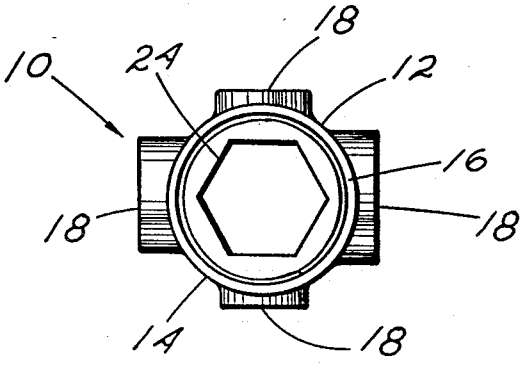
FIG. 2 is an end view of the housing with the socket wrench removed to illustrate the four inherent variable sized sockets.
Figure 3:
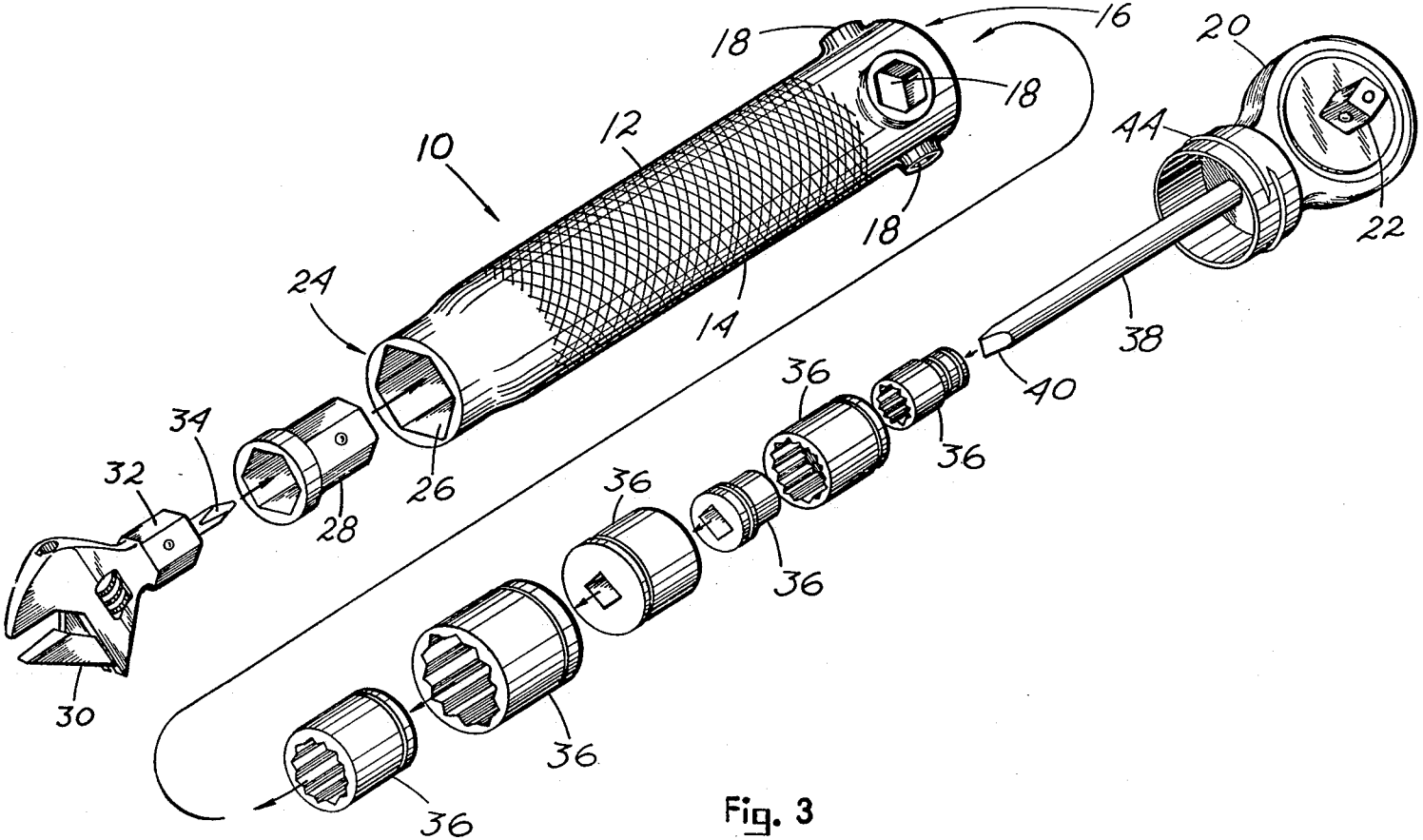
FIG. 3 is an exploded perspective view of the invention showing each individual tool and its assembly position.
Figure 4:
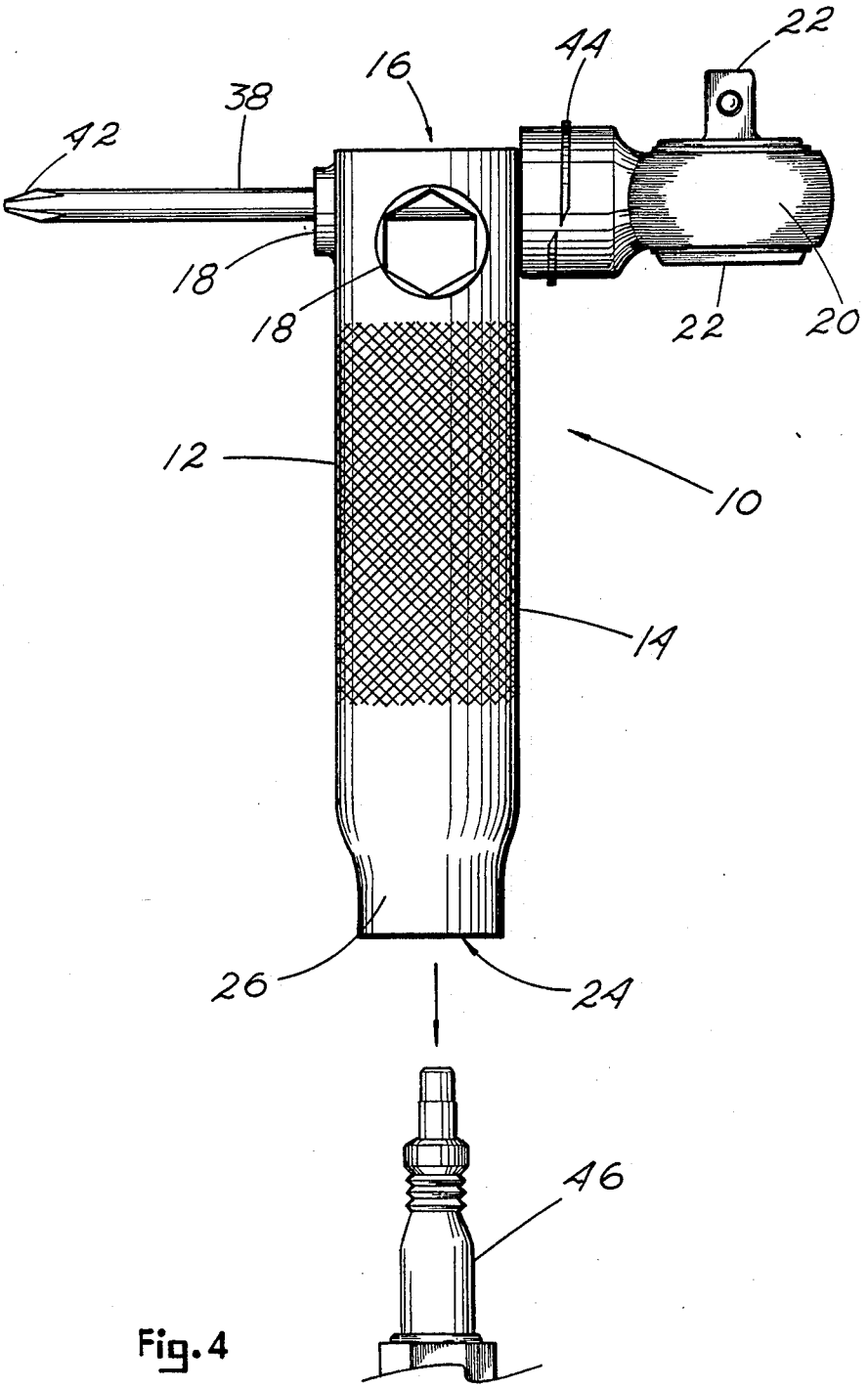
FIG. 4 is an in-use illustration showing the shank of the socket wrench, this time affixed with a Phillips screwdriver, being used as leverage for removal of a spark plug.

Referring now to the drawings where the multipurpose automotive tool kit according to the invention is detailed in various illustrations. For reference purposes the basic kit which includes the handle housing and tool members is designated tool kit 10. In FIG. 1, tool kit 10 is illustrated in an assembled side view. Handle 12 which is also housing 14 for the tool kit 10 assemblage is an elongated open ended tubular member. It is to be understood that handle 12 and housing 14 are used interchangeably hereinafter. At a first handle end 16, handle 12 is ringed by four inherently affixed sockets 18. Sockets 18 are preferably sized 7/16, ½, 9/16 and ¾ inch. A reversible socket drive ratchet head 20 with a quick release 22 for open ended individual sockets 36, FIG. 3, is removably screwed by threaded ratchet drive base 44 into handel 12 adjacent the four inherent handel sockets 18 at first handle end 16. At a second handle end 24, handle 12 narrows and second handle end 24 is formed into a fifth inherent socket useful for large spark plug removal, large spark plug socket 26. Retained removably in large spark plug socket 26, is small spark plug socket 28 which can be used in second handle end 24 of handle 12 or removed to allow use of large sparkplug socket 26. Protruding from handle 12 at second handle end 24 is the head and jaw section of adjustable end wrench 30 removably retained in small spark plug socket 28 by adjustable end wrench base 32. A short Phillips screwdriver 34 is removably affixed to adjustable end wrench base 32 arranged to position inside housing 14 of handle 12. Adjustable end wrench 30 is useful for grasping as a handle when detached from housing 14 for using short Phillips screwdriver 34. See FIG. 3 illustration. Socket drive ratchet head 20 is affixed centrally with an elongated shank 38 which inserts into housing 14 of handle 12. Shank 38 can be installed in the form of either straight blade screwdriver 40 as illustrated in FIG. 3 or long Phillips screwdriver 42 as illustrated in FIG. 4. Removably housed on shank 38, are a multiple of variously sized open ended individual sockets 36 as shown in FIG. 3. Although open ended individual sockets 36 may be standard or metric, standard sizes of ½, ⅜, ⅝, 9/16, 11/16, and ¾ inch are the most useful. Slid onto shank 38, open ended individual sockets 36 are inserted into housing 14 of handle 12 for storage. Metric sizes and universal sockets could obviously replace the fractional size sockets.

As can be understood from the foregoing and seen in the illustrations, the immediate invention is compact and easily stored. A varied assortment of practical tools are supplied in tool kit 10 useful individually as well as with and inherent to handle 12. Socket drive ratchet head 20 as a socket wrench can be used attached to handle 12 using handle 12 as a "cheater" for leverage or socket drive ratchet head 20 can be used detached with shank 38 serving as a leverage handle as shown in FIG. 4. Socket drive ratchet head 20 is also used for gripping when detached from housing 14 as a handle for using either long Phillips screwdriver 42 or shank 38 formed as straight blade screwdriver 40. Adjustable end wrench 30 is used attached to housing 14 so handle 12 can serve for leverage. When a short Phillips screwdriver 34 is needed, adjustable end wrench 30 is unsnapped by being pulled from handle 12 and short Phillips screwdriver 34 can be used with adjustable end wrench 30 for a handle. Shank 38 of socket drive ratchet head 20 can be passed through the smaller two of inherent sockets 18 at first handle end 16 in handle 12 and used as additional leverage when second handle end 24 of handle 12 is used for spark plug 46 removal by either large spark plug socket 26 or small spark plug socket 28. Where space permits, inherent sockets 18 in housing 14 of handle 12 can be used to stabilize the head of a bolt while individual sockets 36 are being used in socket driver ratchet head 20 to tighten or loosen a nut when socket driver ratchet head 20 is being used free with shank 38 as a levering handle. Even though useful socket sizes for inherent sockets 18 and individual sockets 36 have been suggested, it is obvious that other sizes such as metric or combination sockets and other sizes of fractional sockets can be used in conjunction with or in place of the stated sizes.

Although I have described tool kit 10 as a preferred embodiment of the immediate invention with considerable details in the specification and illustrated it in the drawings, the descriptions and illustrations are not presented to limit the invention to a particular mode, therefore, I reserve the right to modify the invention from time to time so long as my modifications remain within the intended scope of the appended claims and modifications made by others which produces a similar device that falls within my claim scope, I will consider to be my invention.

What I claim as my invention is:

1. A multipurpose automotive tool kit having a variety of tools removably attached to and stored in a tubular housing with said housing adapted by releasable fittings as an attachable handle for said tools, said housing structured adjacent a first terminal end in a side wall surface with at least one inherent socket wrench and removably affixed at said first terminal end with a protruding socket drive ratchet head, said socket driver ratchet head affixed to a shank internally disposed in said housing, said shank being a slide-on retainer for different sized open ended socket wrenches compatible with said socket driver ratchet head and removably stored in said housing, said housing shaped at a second terminal end into a first spark plug tool, there being a second spark plug tool for small sized spark plugs removably fitting inside of said first spark plug tool with said second spark plug tool providing removable retention for a base attached to an adjustable end wrench head protruding externally from said second terminal end of said housing.

2. The multipurpose automotive tool kit of claim 1 wherein said socket driver ratchet head affixed to a shank having said shank further adapted as an auxiliary handle for levering said socket driver ratchet head detached from said housing.

3. The multipurpose automotive tool kit of claim 1 wherein said socket driver ratchet head affixed to a shank having said shank further adapted for "cheater" levering of said housing cooperative with said at least one inherent socket wrench in said side wall surface adjacent said first end of said housing during use of either of said sparkplug tools in said second end of said housing.

4. The multipurpose automotive tool kit of claim 1 wherein said socket driver ratchet head affixed to a shank internally disposed in said housing having said shank further adapted as a screwdriver with said screwdriver being useful with said socket driver ratchet head and said shank removed from said housing and having said socket driver head for gripping during use of said screwdriver.

5. The multipurpose automotive tool kit of claim 1 wherein said base removably retained in said second spark plug tool being affixed to an adjustable end wrench head protruding externally from said second end of said housing having said base affixed to a screwdriver internally disposed inside said housing with said adjustable end wrench head used for gripping during use of said screwdriver with said base removed from said second spark plug tool.

* * * * *